United States Patent [19]

Bastian

[11] Patent Number: 4,677,408

[45] Date of Patent: Jun. 30, 1987

[54] SOLENOID COIL CONNECTION

[75] Inventor: Arthur L. Bastian, Parsippany, N.J.

[73] Assignee: G. General Electro-Components, Inc., Glastonbury, Conn.

[21] Appl. No.: 890,123

[22] Filed: Jul. 28, 1986

[51] Int. Cl.[4] ..... H01F 7/08

[52] U.S. Cl. ..... 335/255; 336/192; 335/299

[58] Field of Search ..... 336/192, 196, 197; 335/202, 255, 278, 299

[56] References Cited

U.S. PATENT DOCUMENTS

| | | | |
|---|---|---|---|
| 1,977,122 | 10/1934 | Ehrlich et al. | 336/92 |
| 2,131,483 | 9/1938 | Ringwald | 336/90 |
| 2,556,973 | 6/1951 | Nickells | 338/24 |
| 2,889,524 | 6/1959 | Schmitz | 336/192 |
| 2,941,172 | 6/1960 | Sutton, Jr. | 336/92 |
| 3,189,772 | 6/1965 | Wingler et al. | 310/162 |
| 3,230,490 | 1/1966 | Johnson | 336/198 |
| 3,344,374 | 9/1967 | White | 335/92 |
| 3,407,372 | 10/1968 | Elvers | 336/208 |
| 3,500,274 | 3/1970 | Matsuura et al. | 336/65 |
| 3,544,940 | 12/1970 | Davis | 336/192 |
| 3,546,647 | 12/1970 | Roddy et al. | 336/92 |
| 3,609,610 | 9/1971 | Flentge | 335/202 |
| 4,041,430 | 8/1977 | Hrynewycz | 336/92 |
| 4,149,131 | 4/1979 | Kawamura et al. | 335/278 X |
| 4,228,415 | 10/1980 | Schantz | 335/255 |
| 4,498,067 | 2/1985 | Kumokawa et al. | 336/65 |
| 4,549,158 | 10/1985 | Mitsui et al. | 336/83 |

*Primary Examiner*—George Harris

[57] ABSTRACT

A miniature solenoid comprising an insulating bobbin, having upper and lower skirts, upon which magnet wire is wound to form a coil. The bobbin defines a central bore or passage for axial movement of an armature therein. The bobbin is fitted into a metallic can of magnetic permeable material. The ends of the coil extend below the lower skirt of the bobbin and are connected to external leads at this point. To protect the fragile connections, a spacing member is provided which has an annular boss which receives an extension of the bobbin core and projections thereon which engage the lower skirt of the bobbin and define a space between the spacing member and the bobbin. The spacing member has passages therethrough on either side thereof and on the underside has nipples defined thereon. The connecting wires extend through passages in the spacing member through the nipples which effectively spaces the leads apart. A closure member of generally annular outline and of magnetic material has slots in either side thereof which receive the nipples. The closure member provides a return flux path with the can.

2 Claims, 4 Drawing Figures

SOLENOID COIL CONNECTION

FIELD OF THE INVENTION

This invention relates to solenoids and more particularly relates to miniature solenoids.

BACKGROUND OF THE INVENTION

Generally, solenoids comprise a member of magnetically permeable material formed to provide a return path for magnetic flux created by a coil which, when energized, moves an armature which is coaxial with the coil. An example of such a structure is shown in U.S. Pat. No. 4,041,430.

In small solenoids, there is generally provided a bobbin upon which a coil is wound and the bobbin has a central passage or bore in which the armature may move. In many applications, the bobbin is wound with very fine magnet wire which may be 30 gauge or smaller.

Such small magnet wire presents a problem. These small wires have little mechanical strength and therefore, it is necessary to connect them within the container to stronger leads which extend external of the container.

As solenoids are made smaller, a problem is presented in connecting the small magnet wire on the coil to the external leads, and also maintaining a positioning of the magnet wire so there is no shorting of the coil or contact of the magnet wire with the magnetic material of the container or frame.

Accordingly, the present invention provides a new and improved construction for a miniature solenoid which is small enough to fit into a TO-5 transistor can, which is one-quarter inch high and twenty-three sixty-fourths maximum diameter.

SUMMARY OF THE INVENTION

Briefly stated, the invention in one form thereof comprises an insulating bobbin, having upper and lower skirts, upon which magnet wire is wound to form a coil. The bobbin defines a central bore or passage for axial movement of an armature therein. The bobbin is fitted into a metallic can of magnetic permeable material. The ends of the coil extend below the lower skirt of the bobbin and are connected to external leads at this point. To protect the fragile connections, a spacing member is provided which has an annular boss which receives an extension of the bobbin core and projections thereon which engage the lower skirt of the bobbin and define a space between the spacing member and the bobbin. The spacing member has passages therethrough on either side thereof and on the underside has nipples defined thereon. The connecting wires extend through passages in the spacing member through the nipples which effectively spaces the leads apart. A closure member of generally annular outline and of magnetic material has a press-fit with the can and has slots in either side thereof which receive the nipples. The closure member provides a return flux path with the can.

A solenoid embodying the invention is sufficiently small that it can be mounted directly on a printed circuit board with its armature directly connected to the device to be actuated.

An object of this invention is to provide a new and improved construction for a miniature solenoid.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF THE PREFERRED EMBODIMENT AS ILLUSTRATED

Figure 2:
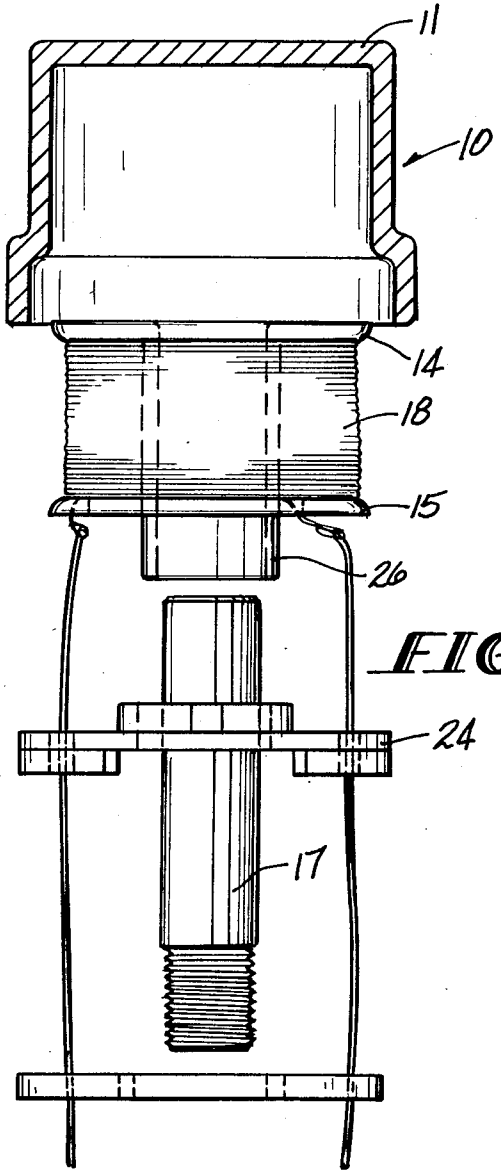
FIG. 2 is an exploded view of the solenoid of FIG. 1.
Figure 1:
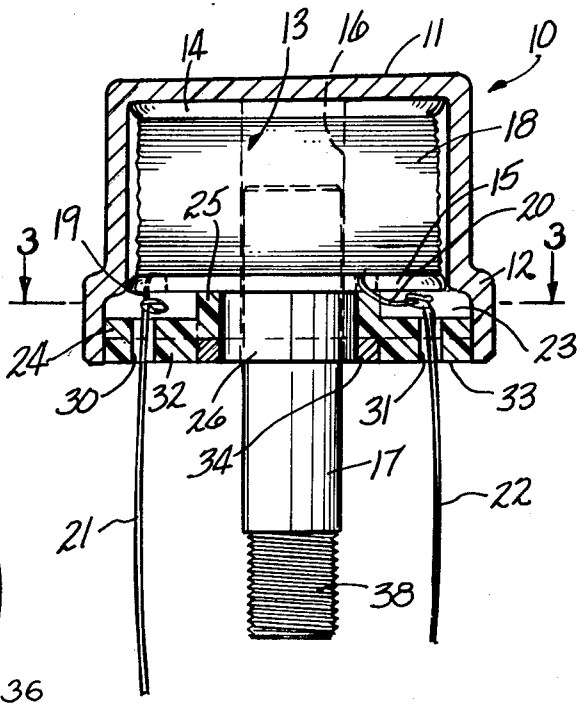
FIG. 1 is a longitudinal half-section view of a solenoid embodying the invention.

A solenoid 10 embodying the invention comprises a container of magnetic permeable material in the form of a cylindrical can with a lower portion 12 of slightly larger diameter. Received within container 11 is a bobbin 13 of non-magnetic material, preferably a low friction material such as nylon. The bobbin 13 has an upper skirt 14 and a lower skirt 15 and a cylindrical central portion which defines a bore 16 which receives a cylindrical armature 17 for linear movement therein. Wound on the bobbin is a coil 18 which has ends 19 and 20 which extend below the lower skirt 15. The ends 19 and 20 of the coil may be very fragile and have little mechanical strength. Therefore, the ends of the magnet wire 19 and 20 are connected to external leads 21 and 22, respectively, in a space 23 defined between the lower skirt 15 and a spacing member 24. The connections 25 and 26 are shown in the space 23. The external leads 21 and 22 are of a size sufficient to provide the necessary mechanical strength.

The ends of the terminal external leads connected to the magnet wire are formed with substantially right angle bends with a partial loop. This is to facilitate soldering to a magnet wire end. The external leads are turned to a position which is outside the periphery of the bobbin and soldered to the magnet wire. Then the external lead is rotated to bring the soldered connection within the space 23. Then the can 11 and spacing member 24 are joined. This permits the solder connections to be made away from the plastic bobbin 13 and plastic spacing member 24.

Figure 3:
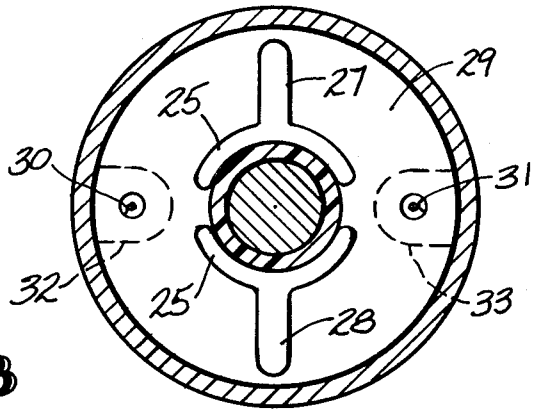
FIG. 3 is a view of the solenoid of FIG. 1 seen in the planes of lines 3—3 of FIGS. 1.
Figure 4:
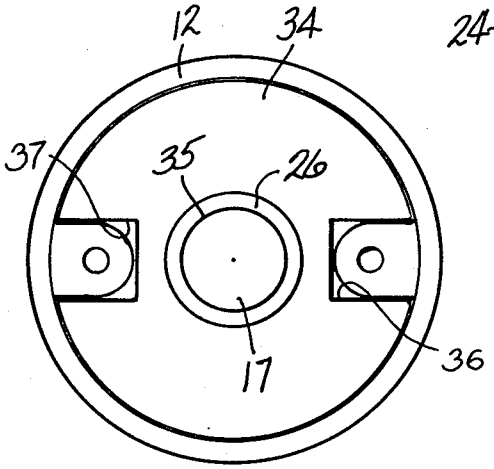
FIG. 4 is a view of the solenoid of FIG. 1 seen in the plane of lines 4—4 of FIG. 1.

Spacing member 24 is annular in configuration and has two arcuate portions defining a partial central boss 25 which telescopically receives an extending end 26 of bobbin 13. The boss 25 may be completely annular if desired. Spacing member 24 further has two projections 27 and 28 (FIG. 3) which engage lower bobbin skirt 15 and space annular flange portion 29 of member 24 a predetermined dimension from lower skirt 15 of bobbin 13. This further defines the space 23 to protect the connections 25 and 26 between leads 19 and 21 and 20 and 22.

Defined in the annular flange 29 are passages 30 and 31 which are diametrically spaced apart and extend through nipples 32 and 33, respectively, which are diametrically spaced apart on the underside of spacing member 24.

The bottom of the container is closed by a generally annular metallic member 34 of magnetic permeable material, which has a central opening 35 to permit passage of armature 17 therethrough Cutout slots 36 and 37 are defined in member 34 therein on diametrically opposite sides thereof to permit passage of nipples 31 and 32 therethrough. Member 34 provides a magnetic return path with container 11 and may have a press-fit with the inner periphery of portion 12 or other means of attachment.

This construction provides good insulation for the connections of terminating ends of the magnet wire at the bottom of the bobbin and provides mechanical stability while maintaining the spacing of the leads, and permits the construction of very small solenoids which may be directly mounted to a printed circuit board. The armature 17 may have a threaded end 38 for direct attachment to a device which is to be actuated.

It may thus be seen that the objects of the invention set forth, as well as those made apparent from the foregoing description, are efficiently attained. A preferred embodiment of the invention has been set forth for purposes of disclosure, however, modifications to the disclosed embodiment of the invention, as well as other embodiments thereof, may occur to those skilled in the art. Accordingly, the appended claims are intended to cover all embodiments of the invention and modifications to the disclosed embodiment which do not depart from the spirit and scope of the invention.

Having thus disclosed the invention, what is claimed is:

1. A solenoid comprising, a cylindrical metallic can having an open lower end, a bobbin within said can having an energizable coil wound thereon and defining a central bore for receiving an armature therein, said bobbin having upper and lower annular skirts positioning said bobbin in said can, said bobbin having a lower central boss defining a continuation of said central bore, an annular spacing member tightly received in said can, said spacing member having an annular boss concentrically receiving said lower central boss and having at least one spacing protrusion which spaces said spacing member from said lower skirt and defines a space between said spacing member and said lower skirt, said coil having a pair of leads extending therefrom into said defined space, said spacing member having a pair of bosses extending downwardly therefrom for passages of connecting wires, said spacing member having a pair of bosses extending downwardly therefrom for passages of connecting wires, a pair of connecting wires extending through said downwardly extending bosses and connected to said coil leads in said defined space between said lower skirt and said spacing member, said connecting wires being electrically connected to said coil leads in said defined space, a cylindrical armature in said defined bore and having a portion extending below said lower skirt in at least one position of operation, a generally annular magnetic member having a central bore therein to permit clearance for said armature, said annular magnetic member having slots therein which receive said downwardly extending bosses of said spacing member, said generally annular magnetic member being in contact with said can.

2. The solenoid of claim 1, wherein said generally annular magnetic member has a press-fit with said can.

* * * * *